US006693503B1

(12) United States Patent
Nguyen et al.

(10) Patent No.: US 6,693,503 B1
(45) Date of Patent: Feb. 17, 2004

(54) RELAY, IN PARTICULAR FOR A STARTING DEVICE

(75) Inventors: Ngoc-Thach Nguyen, Grossbottwar (DE); Quang-Ngoc Tran, Stuttgart (DE); Arno-Albert Binnewies, deceased, late of Hildesheim (DE), by Anna Elisabeth Westermann-Binnewies, Carmen Binnewies, legal representatives; Werner Sander, Hildesheim (DE); Heinz Stichnoth, Elze (DE); Karl-Wilhelm Boecker, Algermissen (DE); Andreas Hamerich, Hildeshiem (DE); Lutz Lehnert, Holle (DE); Josef Weigt, Vaihingen (DE); Gunter Meyer, Toluca (MX); Dietmar Krause, Hildesheim (DE); Hans-Joachim Binio, Hildesheim (DE)

(73) Assignee: Robert Bosch Company, Stuttgart (DE)

( * ) Notice: Subject to any disclaimer, the term of this patent is extended or adjusted under 35 U.S.C. 154(b) by 81 days.

(21) Appl. No.: 09/868,583

(22) PCT Filed: Oct. 20, 2000

(86) PCT No.: PCT/DE00/03704

§ 371 (c)(1),
(2), (4) Date: Jan. 8, 2002

(87) PCT Pub. No.: WO01/31668

PCT Pub. Date: May 3, 2001

(30) Foreign Application Priority Data

Oct. 23, 1999 (DE) ..... 199 51 116

(51) Int. Cl.[7] ..... H01H 67/02

(52) U.S. Cl. ..... 335/131; 335/132; 335/255; 335/262

(58) Field of Search ..... 335/127–132, 335/255, 261–264, 273, 274

(56) References Cited

U.S. PATENT DOCUMENTS

| | | | | |
|---|---|---|---|---|
| 4,243,964 A | | 1/1981 | Boegner | 335/156 |
| 5,677,656 A | * | 10/1997 | Mauch et al. | 335/126 |
| 5,986,528 A | * | 11/1999 | Meier et al. | 335/6 |

FOREIGN PATENT DOCUMENTS

| | | |
|---|---|---|
| DE | 41 17 242 C1 | 7/1992 |
| GB | 2 289 795 A | 11/1995 |

* cited by examiner

*Primary Examiner*—Ramon M. Barrera
(74) *Attorney, Agent, or Firm*—Michael J. Striker

(57) ABSTRACT

A relay (10), in particular for a starter for an internal combustion engine, is proposed. The relay (10) includes a relay coil (13) and a solenoid armature (22) which can be moved when full battery current flows to the relay coil (13). A contact member (37) can be actuated by the solenoid armature (22), whereby an operating lever (31) is situated on the contact member (37). It is provided that a coupling element (46) connects the operating lever (31) and the solenoid armature (22) with each other in a manner that allows them to slide with limits.

14 Claims, 2 Drawing Sheets

Figure 1:
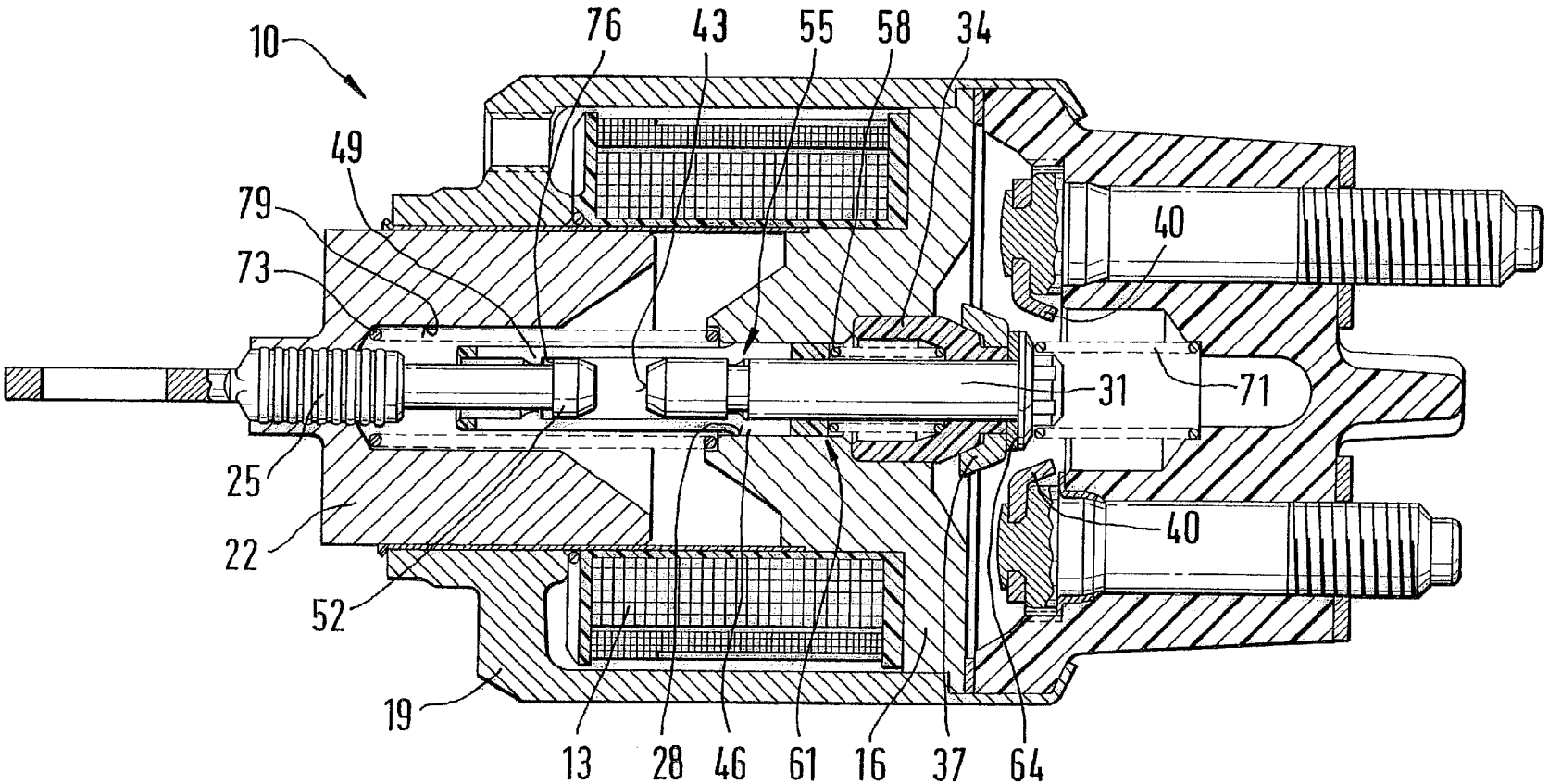

10
34
58
55
43
76
49
79
73
40
71
31
40
25
22
52
19
13
28
46
61
16
37
64

RELAY, IN PARTICULAR FOR A STARTING DEVICE

BACKGROUND INFORMATION

The invention relates to a relay, in particular for a starter of an internal combustion engine, according to the general class of the independent claim.

Relays for starters of internal combustion engines are made known in DE 411 72 42 C1, for instance. The known relay includes a relay coil with a solenoid armature that can be moved when full battery current flows to the relay coil. As a result of the movement of the solenoid armature in the coil, a plunger attached to the solenoid armature is pressed against an operating lever after completing free travel. A contact member connected with the operating lever is thereby pushed in a straight line until it stops against two mating contacts, and a switch of an electrical circuit of a starter motor is thereby closed.

This known relay has the disadvantage, among others, that the solenoid armature can be lost, which makes handling of the relay difficult when mounting it on the starter. A further disadvantage is that only one contact return spring releases the contact member from the mating contacts, and this is insufficient to open the electrical circuit of the starter motor when "contact welding" takes place under unfavorable conditions.

ADVANTAGES OF THE INVENTION

Using the relay according to the invention having the features of the independent claim, it is possible, on the one hand, to design the relay in such a manner that the solenoid armature cannot be lost and, on the other hand, that the kinetic energy of the solenoid armature can be utilized after the relay coil is switched off to open the switch of the electrical circuit of the starter motor. A coupling element is provided for this purpose that connects the operating lever and the solenoid armature with each other in a manner that allows them to slide with limits.

Advantageous further developments and improvements of the features indicated in the independent claim arise out of the provisions listed in the subclaims.

Using a contact member situated on an operating lever, it is possible for the contact member to come in contact with mating contacts of the relay when full battery current flows to the relay coil. In this manner it is possible, for instance, to close the starter motor electrical circuit and by the switching-on. So that the contact member opens the starter motor switch after the intended end of the starting procedure and, therefore, after full battery current stops flowing to the relay coil, the solenoid armature is acted upon by a reset force that acts against the engaging direction of the relay. The coupling element is arranged in such a way that the solenoid armature can slide with limits in the reset direction in front of the operating lever. It is thereby possible that the solenoid armature carries the operating lever along by way of the coupling element, thereby making it possible to open the starter motor switch, in particular under unfavorable conditions such as when contact welding occurs. The operating lever includes an exposed frontal area that serves as the stop for a plunger attached to a solenoid armature. It is therefore possible that, during the engaging procedure, the solenoid armature presses against the operating lever by way of the plunger and thereby presses the contact member against the mating contacts to close the starter motor switch. The coupling element partially surrounds both the operating lever and the plunger. This is an advantage in particular when the coupling element is connected with the operating lever by way of a snap-on connector, because the coupling element can then be pushed over the operating lever more easily. A simple and cost-effective variant of a connection between the coupling element of the operating lever and the plunger is given in that the coupling element surrounds the operating lever and the plunger in the shape of a sleeve. A sleeve-shaped coupling element is an advantage in particular when the coupling element is made of sheet metal shaped like a sleeve. This also makes it easy to push it over the operating lever and the plunger. The coupling element fits behind either a corresponding counter-projection on the plunger or a corresponding counter-projection on the solenoid armature by way of at least one projection. If the solenoid armature does not include a plunger, the only possibility is to provide a projection on the solenoid armature itself. If the solenoid armature includes a projection, however, it is an advantage to provide the projection on the plunger, because the coupling element is not designed too large. In a further variant, the coupling element is designed in such a way that the operating lever is guided in a passage through the solenoid armature. If the coupling element is developed in sections in such a way that it guides the operating lever in a passage through the solenoid armature, the collar that is created as a result or that is present can be used so that a spring element rests against it and a contact member presses into a position removed from the coupling element.

DRAWINGS

The invention is explained in greater detail below in two design examples using the associated drawings.

Figure 2:
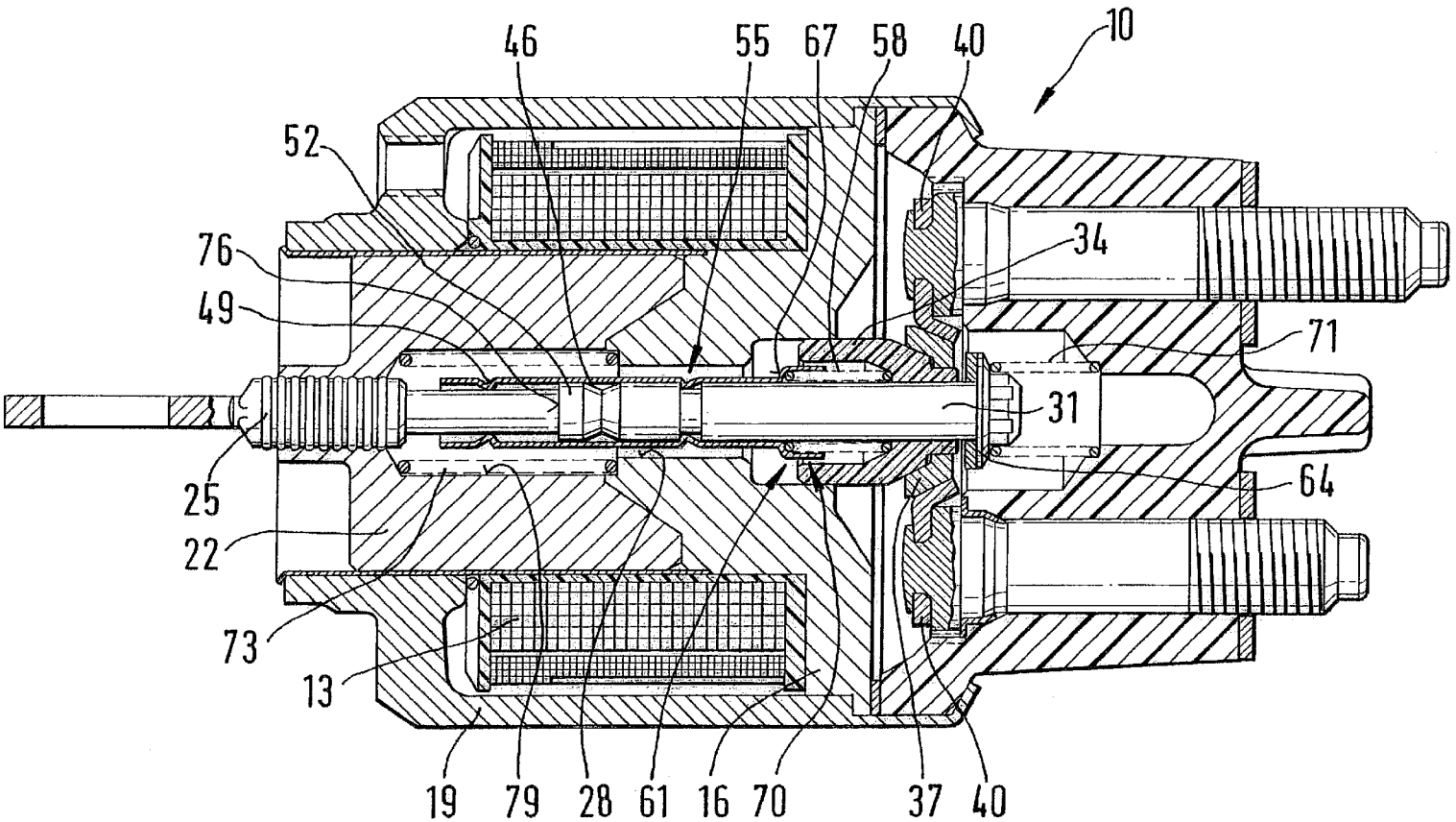

FIG. 1 shows a longitudinal cross-section of a first design example of a relay according to the invention, FIG. 2 shows a longitudinal cross-section of a second design example of a relay according to the invention.

DESCRIPTION OF THE DESIGN EXAMPLES

Identical or equally-acting components are indicated with the same reference numbers.

FIG. 1 shows a first design example of a relay 10 according to the invention, in particular for a starter of an internal combustion engine. The relay 10 includes a relay coil 13 on which a magnet core 16 is situated. The relay coil 13 is inserted in a housing 19. A movable solenoid armature 22 with which a plunger 25 is firmly connected is allocated to the relay coil 13. An operating lever 31 is guided on axis in a passage 28 of the magnet core 16 by way of a sleeve-shaped element 34 made of insulating material, which simultaneously serves as a receptacle for a contact member 37. The contact member 37 can also slide on axis in the passage 28 with the operating lever 31. If the contact member 37 reaches an end position, it makes contact with mating contacts 40 of the relay. As a result of the contact of the contact member 37 with the mating contacts 40, an electrical circuit of a non-depicted starter motor is closed, so that full current can flow from a battery to the starter motor by way of the contact member 37.

If full battery current flows to the relay coil 13, the solenoid armature 22 is drawn through a magnetic field that surrounds the housing 19, the magnet core 16, and the solenoid armature 16, into the relay coil 13 until it touches a frontal area of the magnet core 16. This drawing-in movement determines an engaging direction. The plunger 25 is therefore moved in the direction of the operating lever 31 and finally comes in contact with an exposed frontal area 43 of the operating lever 31, thereby exerting pushing power on the operating lever 31 and the contact member 37 connected with this. See FIG. 2.

A coupling element 46 is provided in the relay 10 that connects the operating lever 31 and the solenoid armature 22 with each other in a manner that allows them to slide with limits. As indicated in FIG. 1, the coupling element 46 is arranged in such a way that the solenoid armature 22 can slide with limits in a reset direction that is opposed to the engaging direction, in front of the operating lever 31. In the design examples according to FIG. 1 and FIG. 2, this is achieved in that, on the one hand, the coupling element 46 is not connected with the operating lever 31 in a manner that allows it to slide, and, on the other, that the coupling element 46 includes a projection 49 that fits behind a corresponding counter-projection 52 on the plunger 25. The counter-projection 52 can slide freely between the projection 49 and the free frontal area 43. In both examples, the operating lever 31 is connected with the coupling element 46 by way of a snap-on connector 55. In both design examples, the coupling element 46 partially surrounds both the operating lever 31 and the plunger 25 and, due to the basically cylindrical form of the coupling element 46, the coupling element 46 surrounds the operating lever 31 and the plunger 25 in the shape of a sleeve.

A spring element 58 is provided in both design examples that rests against an end section 61 of the coupling element 46 that is opposite to the solenoid armature 22, and the contact member 37 presses into a position that is removed from the coupling element 46. Before the contact member 37 connects the two mating contacts 40 electrically, this removed position is determined by a stop 64 firmly connected to the operating lever 31. See also FIG. 1. If the operating lever 31 is located in the closed position, however, the position that is removed from the coupling element 46 is determined by the mating contacts 40. In FIG. 1, the spring element 58 thereby rests against an inner surface of the sleeve-shaped element 34 and, on the other side, against a frontal area of the end section 61 of the coupling element 46. In contrast, the spring element 58 rests against a collar 67 of the coupling element 46 in the design example according to FIG. 2.

So that the coupling element 46 can guide the operating lever 31 in the passage 28 of the magnet core 16, the outer diameter of the end section 61 of the coupling element 46 is enlarged so that a suitable passage is produced between the end section 61 and the passage 28. For the same purpose, the coupling element 46 is extended in the shape of a sleeve in the second design example in such a way that the spring element 58 is accommodated within a sleeve-shaped extension 70 on the one hand, and, on the other, the sleeve-shaped extension 70 has a suitable outer diameter so that a matching guidance of the coupling element 46 in the passage 28 is produced.

During a starting procedure, the solenoid armature 22 is drawn into the relay coil 13 and presses with its plunger 25 against the operating lever 31. In turn, the coupling element 46 connected with the operating lever 31 presses the contact member 37 against the two mating contacts 40 by way of the spring element 58 and the sleeve-shaped element 34. In unfavorable shifting states, welding can thereby take place between the contact member 37 and the mating contacts 40. As a result of this welding, in unfavorable conditions with the known relay, full battery current flows to the starter motor for an unnecessarily long time even after a starter switch is opened and, therefore, the fading force between the plunger 25 and the operating lever 31 and the force of a contact return spring 71, which can lead to overloading and, finally, to failure of the starter motor. If the starter switch with the relay 10 according to the invention is opened, however, battery current first stops flowing to the relay coil 13, as with the known relay 10. As a result, the solenoid armature 22 is pressed into its initial position by a reset force. The reset force can be created by a return spring 73 inside the solenoid armature 22, for instance, as shown in the two design examples. The solenoid armature 22, which is finally accelerated by the reset force, carries the operating lever 31 along with it by way of the coupling element 46 in the relay 10 according to the invention, and this carries the contact member 37 along with it by way of the stop 64 and it finally pulls it loose from the two mating contacts 40. For this purpose, the plunger 25 includes a plunger collar 76 that carries the coupling element 46 along on its projection 46 when the solenoid armature 22 moves in the reset direction. A pulse is therefore transferred by way of the coupling element 46 and the snap-on connector 55 to the operating lever 31 and then by way of the stop 64 to the contact member 37, and this contact member 37 is therefore abruptly pulled loose from the mating contacts 40.

As an alternative to the two design examples, it is also possible that the coupling element 46 includes a projection 49 that is directed radially outward which fits behind a counter-projection 52 that is equivalent to the counter-projection 52 of the plunger 25 in a recess 79 of the solenoid armature 22. In this case, the reset force is to be created, for instance, in that a spring element creates this reset force outside of the solenoid armature 22.

The coupling element 46 according to FIG. 1 represents an injection-molded part made of plastic. The coupling element 46 according to FIG. 2 is a variant made of sheet metal that is manufactured by rolling a sheet-metal strip.

What is claimed is:

1. A relay (10), in particular for a starter for an internal combustion engine, having a relay coil (13) and a solenoid armature (22) which can be moved when current flows to the relay coil (13), and having a contact member (37) that can be actuated by the solenoid armature (22), whereby an operating lever (31) is situated on the contact member (37), characterized in that a coupling element (46) is provided that connects the operating lever (31) and the solenoid armature (22) with each other and is arranged so that by means of the coupling element (46) the operating lever (31) and the solenoid armature (22) are limitedly slidable in a reset direction relative to one another.

2. Relay according to claim 1, characterized in that the solenoid armature (22) is moved in an engaging direction of the relay (10) when current flows to the relay coil (13) in such a manner that the contact member (37) makes contact with mating contacts of the relay.

3. Relay according to claim 2, characterized in that the solenoid armature (22) is acted upon by a reset force that acts against the engaging direction of the relay (10) in the reset direction.

4. Relay according to claim 3, characterized in that the coupling element (46) is arranged in such a way that the solenoid armature (22) can slide with limits in the reset direction in front of the operating lever (31).

5. Relay according to claim 1, characterized in that the operating lever (31) has an exposed frontal area (43) that serves as a stop for a plunger (25) attached to the solenoid armature (22).

6. Relay according to claim 5, characterized in that the plunger (25) includes a plunger collar (76).

7. Relay according to claim 1, characterized in that the coupling element (46) and the operating lever (31) are held in place on an axis in relation to each other.

8. Relay according to claim 1, characterized in that the coupling element (46) guides the operating lever (31) in a passage (28) through the solenoid armature (22).

9. Relay according to claim 1, characterized in that a spring element (58) is provided that rests against an end section (61) of the coupling element (46) that is opposite to the solenoid armature (22), and the contact member (37) presses into a position removed from the coupling element (46).

10. A relay (10), in particular for a starter for an internal combustion engine, having a relay coil (13) and a solenoid armature (22) which can be moved when current flows to the relay coil (13), and having a contact member (37) that can be actuated by the solenoid armature (22), whereby an operating lever (31) is situated on the contact member (37), characterized in that a coupling element (46) is provided that connects the operating lever (31) and the solenoid armature (22) with each other in a manner that allows them to slide with limits, wherein the operating lever (31) has an exposed frontal area (43) that serves as a stop for a plunger (25) attached to the solenoid armature (22) and wherein the coupling element (46) partially surrounds both the operating lever (31) and the plunger (25).

11. A relay (10), in particular for a starter for an internal combustion engine, having a relay coil (13) and a solenoid armature (22) which can be moved when current flows to the relay coil (13), and having a contact member (37) that can be actuated by the solenoid armature (22), whereby an operating lever (31) is situated on the contact member (37), characterized in that a coupling element (46) is provided that connects the operating lever (31) and the solenoid armature (22) with each other in a manner that allows them to slide with limits, wherein the operating lever (31) has an exposed frontal area (43) that serves as a stop for a plunger (25) attached to the solenoid armature (22), and wherein the coupling element (46) surrounds the operating lever (31) and the plunger (25) in the shape of a sleeve.

12. A relay (10), in particular for a starter for an internal combustion engine, having a relay coil (13) and a solenoid armature (22) which can be moved when current flows to the relay coil (13), and having a contact member (37) that can be actuated by the solenoid armature (22), whereby an operating lever (31) is situated on the contact member (37), characterized in that a coupling element (46) is provided that connects the operating lever (31) and the solenoid armature (22) with each other in a manner that allows them to slide with limits, wherein the operating lever (31) is connected with the coupling element (46) by way of a snap-on connector.

13. A relay (10), in particular for a starter for an internal combustion engine, having a relay coil (13) and a solenoid armature (22) which can be moved when current flows to the relay coil (13), and having a contact member (37) that can be actuated by the solenoid armature (22), whereby an operating lever (31) is situated on the contact member (37), characterized in that a coupling element (46) is provided that connects the operating lever (31) and the solenoid armature (22) with each other in a manner that allows them to slide with limits, wherein the operating lever (31) has an exposed frontal area (43) that serves as a stop for a plunger (25) attached to the solenoid armature (22), wherein the coupling element (46) includes at least one projection (49) that fits behind a corresponding counter-projection (52) on the plunger (25) or solenoid armature (22).

14. A relay (10), in particular for a starter for an internal combustion engine, having a relay coil (13) and a solenoid armature (22) which can be moved when current flows to the relay coil (13), and having a contact member (37) that can be actuated by the solenoid armature (22), whereby an operating lever (31) is situated on the contact member (37), characterized in that a coupling element (46) is provided that connects the operating lever (31) and the solenoid armature (22) with each other in a manner that allows them to slide with limits, wherein a spring element (58) is provided that rests against an end section (61) of the coupling element (46) that is opposite to the solenoid armature (22), and the contact member (37) presses into a position removed from the coupling element (46), and wherein the spring element (58) rests against a collar (67) of the coupling element (46).

* * * * *